United States Patent [19]

Urbani

[11] Patent Number: 4,771,503

[45] Date of Patent: Sep. 20, 1988

[54] TANK CLEANING SYSTEM

[75] Inventor: William G. Urbani, Stockton, Calif.

[73] Assignee: Industrial Innovations, Inc., Stockton, Calif.

[21] Appl. No.: 617,765

[22] Filed: Jun. 6, 1984

Related U.S. Application Data

[60] Division of Ser. No. 382,900, May 28, 1982, Pat. No. 4,466,154, which is a continuation-in-part of Ser. No. 222,472, Jan. 5, 1981, abandoned.

[51] Int. Cl.[4] ..... B08B 9/00; B08B 3/02

[52] U.S. Cl. ..... 15/302; 134/104; 210/534

[58] Field of Search ..... 15/302; 134/10, 94, 134/96, 103, 104, 109, 110, 111, 169 R, 172, 184, 198; 210/242.3, 521, 534, 537

[56] References Cited

U.S. PATENT DOCUMENTS

| | | | |
|---|---|---|---|
| 2,139,096 | 12/1938 | Piquerez | 134/111 X |
| 2,239,507 | 4/1941 | Pierce | 280/5 D |
| 2,814,531 | 11/1957 | Murray | 408/106 |
| 2,834,359 | 5/1958 | Kearney | 134/111 X |
| 2,860,785 | 11/1958 | Gardner | 134/111 X |
| 2,894,861 | 7/1959 | Slover et al. | 134/111 X |
| 3,046,163 | 7/1962 | Kearney et al. | 134/111 X |
| 3,140,828 | 7/1964 | Galanor | 134/109 X |
| 3,317,142 | 5/1967 | Casale | 239/172 X |
| 3,372,704 | 3/1968 | Ashworth | 134/109 |
| 3,447,545 | 6/1969 | Lawter | 134/109 |
| 3,502,215 | 3/1970 | Cahan | 134/109 X |
| 3,774,625 | 11/1973 | Wiltrout | 134/104 |
| 3,889,701 | 6/1975 | Mueller | 280/5 D X |
| 3,979,290 | 9/1976 | Loffler | 210/534 X |
| 4,111,716 | 9/1978 | Stevenson | 15/302 X |
| 4,134,174 | 1/1979 | Flynn et al. | 15/302 |
| 4,168,562 | 9/1979 | Maasberg | 15/340 X |

FOREIGN PATENT DOCUMENTS 52325 5/1981 Japan .

*Primary Examiner*—Harvey C. Hornsby
*Assistant Examiner*—Scott J. Haugland
*Attorney, Agent, or Firm*—Townsend and Townsend

[57] ABSTRACT

A tank cleaning system wherein a cleaning liquid is sprayed into a dirty tank and simultaneously sucked out of the tank. The cleaning liquid is stored in a pressure vessel and incompletely fills the vessel to leave a space above the liquid. A pump draws the liquid from the bottom of the vessel through a line to be sprayed into the tank to be cleaned. A vacuum is created within the space above the free surface of the liquid within the pressure vessel by a vacuum pump. While spraying the cleaning fluid into the tank, a vacuum line sucks up the cleaning liquid and dislodged contaminants from the bottom of the tank. The vacuum line terminates at the pressure vessel so that cleaning liquid and contaminants are discharged into the vessel so that cleaning liquid and contaminants never pass through the vacuum pump. Solids settling on the bottom of the vessel are pumped out into a solids separator. Liquid collected by the solid separator is sucked back into the vessel by the vacuum in the vessel.

9 Claims, 4 Drawing Sheets

TANK CLEANING SYSTEM

This is a division of U.S. patent application Ser. No. 382,900, filed May 28, 1982, now U.S. Pat. No. 4,466,154, which is a continuation-in-part of my copending U.S. patent application Ser. No. 222,472, abandoned, filed Jan. 5, 1981, for TANK CLEANING SYSTEM.

FIELD OF THE INVENTION

The present invention is related to pressurized cleaning apparatus, particularly one which uses a vacuum line for the pickup of the cleaning liquid and dislodged contaminants.

BACKGROUND OF THE INVENTION

Industrial tanks must often be cleaned, commonly after the tank is empty. To do so the interior of the tank or other container is usually sprayed with high pressure cleaning liquids to dislodge the contaminants, both liquid and solid, from the tank surfaces. Because the impact of the high pressure spray is diffused if there is a liquid layer within the tank, it is desirable to keep the amount of cleaning liquid which gathers in the bottom of the tank to a minimum.

Removing cleaning liquid from the bottom of the tank is often accomplished by using positive displacement pumps. However, positive displacement pumps are often sensitive to solid contaminants in the liquid being pumped because of the small clearances necessary in their construction. Further, the valves commonly used are also sensitive to foreign solid material. These foreign solids can often lead to the early destruction of the pump. Centrifugal pumps are sometimes used; however, they generally do not work well when air is mixed with the liquid. Therefore, what has been missing in the prior art is a cleaning system insensitive to both drawing solid contaminants from the bottom of the tank and to drawing air in with the cleaning liquid.

Oil tankers pose special problems for tank cleaning apparatus. Oil as pumped out of the ground commonly contains rocks, sand and gravel. In addition to this naturally present foreign matter, a great number of rags find their way into the oil holding compartments of oil tankers. The presence of contaminants of types which both float and sink create additional problems during cleaning operations.

Railroad tank cars are typically cleaned by transporting them to special cleaning facilities. Just getting the tank car to the cleaning facility is expensive and time-consuming. However, highly mobile tank car cleaning units, which could be driven to the railroad tank car, are not generally available.

SUMMARY OF THE INVENTION

A tank cleaning system wherein a cleaning liquid is sprayed into the tank and simultaneously sucked out of the tank is disclosed. The cleaning liquid is stored in a pressure vessel and incompletely fills the vessel so that a space is left above the free surface of the liquid. A pressure pump draws the liquid from the lower regions of the vessel and forces the liquid through a pressure line to a gas fired heat exchanger. As the cleaning liquid passes through the heat exchanger it is heated and then passes through a line where the high pressure, high temperature liquid is used to clean inside of the tank.

Simultaneously with the spraying of high pressure, high temperature cleaning liquid in the tank, a vacuum line draws the sprayed cleaning liquid and dislodged contaminants from the bottom of the tank. The vacuum line terminates at the pressure vessel where the cleaning liquid and contaminants are discharged into the cleaning liquid therein. A vacuum is created within the space above the free surface of the liquid within the pressure vessel by a vacuum pump. In this way, cleaning liquid and contaminants withdrawn from the tank never pass through the vacuum pump.

In the preferred embodiment, a pair of pressure vessels are mounted to a trailer for mobility. One of the vessels typically is used for the cleaning operation and the other is used for the rinse. Both are connected through valves to a common pressure pump for the application of high pressure liquid to the interior of the tank to be cleaned. It should be noted that the present invention will be described with regard to cleaning a tank. However, the invention can be used for cleaning various surfaces, even a room or a roadway, wherein the cleaning liquid collects at a low point for return to the pressure vessel.

A four-way valve is connected to the vacuum pump so that it either pulls a vacuum on one of the pressure vessels or pressurizes the pressure vessel. The latter allows one of the pressure vessels to clean the other. To do so, one vessel is pressurized, the vessels are connected through their liquid outlets and the high pressure from one tank causes the liquid within that tank to clean out the other, non-pressurized, tank.

A container for holding concentrated cleaning agents is also mounted to the trailer, typically between the two tanks. Metering apparatus allows the controlled introduction of the concentrated cleaning agent into the cleaning liquid prior to passing through the pressure pump. This allows the concentration of the cleaning agent to be varied according to circumstances.

When cleaning tanks in which there are substantial amounts of solid contaminants, additional apparatus is interposed along the vacuum line between the tank being cleaned and the suction inlet of the pressure vessel containing the cleaning liquid. A heavy sediment separator tank, having a funnel shaped bottom for collecting rocks and other heavy sediment, is used to remove solid sediment. A progressive cavity pump pumps the mixture of solid and liquid from the solid/liquid outlet of the separator tank to a solid separator where the solids are separated from the liquid. The liquid at the solid separator is collected in a liquid pot.

A partial vacuum is produced within the separator tank through a line connected to the suction inlet of the pressure vessel. The vacuum line connects the interior of separator tank with the tank being cleaned. The line connecting the suction inlet and the separator tank is also connected to a liquid outlet of the liquid pot. During normal operation liquid is drawn back into the pressure vessel from the liquid pot while vapors and gasses are drawn back into the pressure vessel from the separator tank.

An alternative embodiment, especially adapted for use when solid contaminants are plentiful, uses a single main vacuum tank which combines the functions of the separator tank and the pressure vessel. With any of the embodiments the system, when used to clean a dirty tank which can be substantially sealed, can be a closed loop so no gases or vapors are allowed to escape into the atmosphere. This is accomplished by connecting the exhaust from the vacuum pump directly into the dirty tank being cleaned.

A primary advantage resulting from the present invention accrues through the use of an isolated vacuum pump for sucking up the cleaning liquid and contaminants from the bottom of the tanks. The vacuum pump, being isolated from any flow of liquids or solids, operates relatively independently of the amount or size of dirt and abrasives and also the amount of air which may be sucked in along with the liquids and solids. Therefore, a relatively high suction force can be maintained to insure that the bottom of the tank being cleaned is substantially free from having the cleaning liquid form puddles. Therefore, pump life and cleaning efficiency are both increased. Also, because the vacuum pump operates effectively when a substantial amount of air is sucked through the vacuum line along with the cleaning liquid and contaminants, the tank being cleaned is prevented from emitting gases and vapors. This is a distinct advantage when the emissions are noxious or toxic to the personnel who must operate the spraying equipment at the opening in the tank. If needed, scrubbers can be added to remove any particular compound from the cleaning liquid and gases passing through the vacuum line.

Another significant advantage of the present invention is its mobility. By mounting the appartus to a trailer the cleaning system can be moved to the tanks to be cleaned. Railroad tank cars can be cleaned almost anywhere while tanks on ships can be cleaned while docked along a wharf or pier.

The present invention also provides for heating the pressurized cleaning liquid prior to being sprayed into the tank, thus greatly increasing its cleaning effectiveness. Provision of the separate container for holding concentrated cleaning agents and the associated metering apparatus allows greater flexibility in the concentrations used for different jobs and also at different times in the same job. More effective and more efficient use of the cleaning agent is thus insured.

Other features and advantages of the present invention will be apparent from the following description in which the preferred embodiments are set forth in detail in conjunction with the accompanying drawings.

DETAILED DESCRIPTION OF THE PREFERRED EMBODIMENTS

Figure 1:
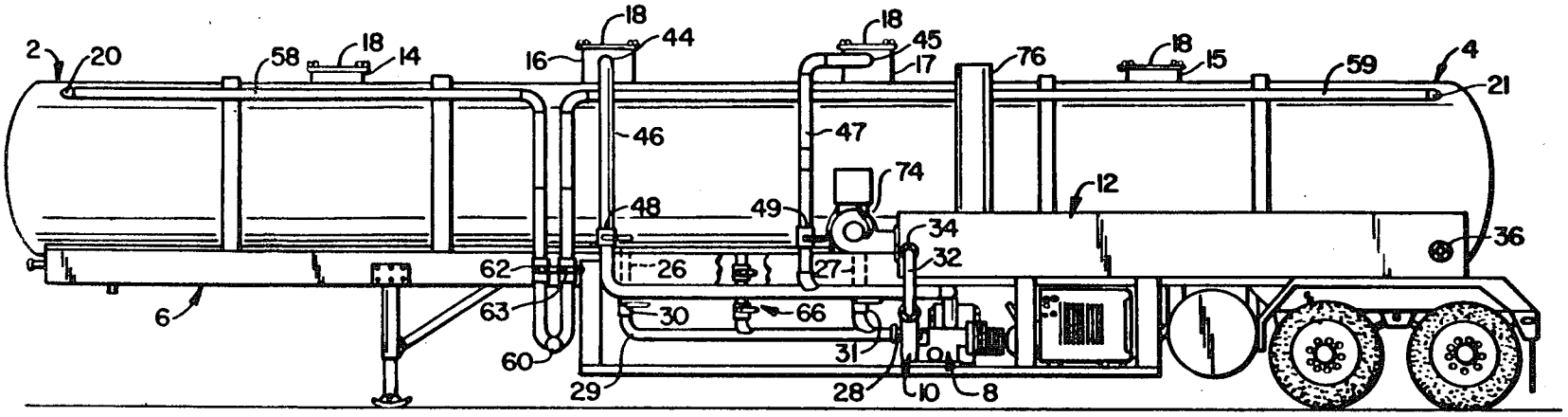
FIG. 1 is a side elevational view of the present invention, including two pressure vessels mounted to a trailer.
Figure 2:
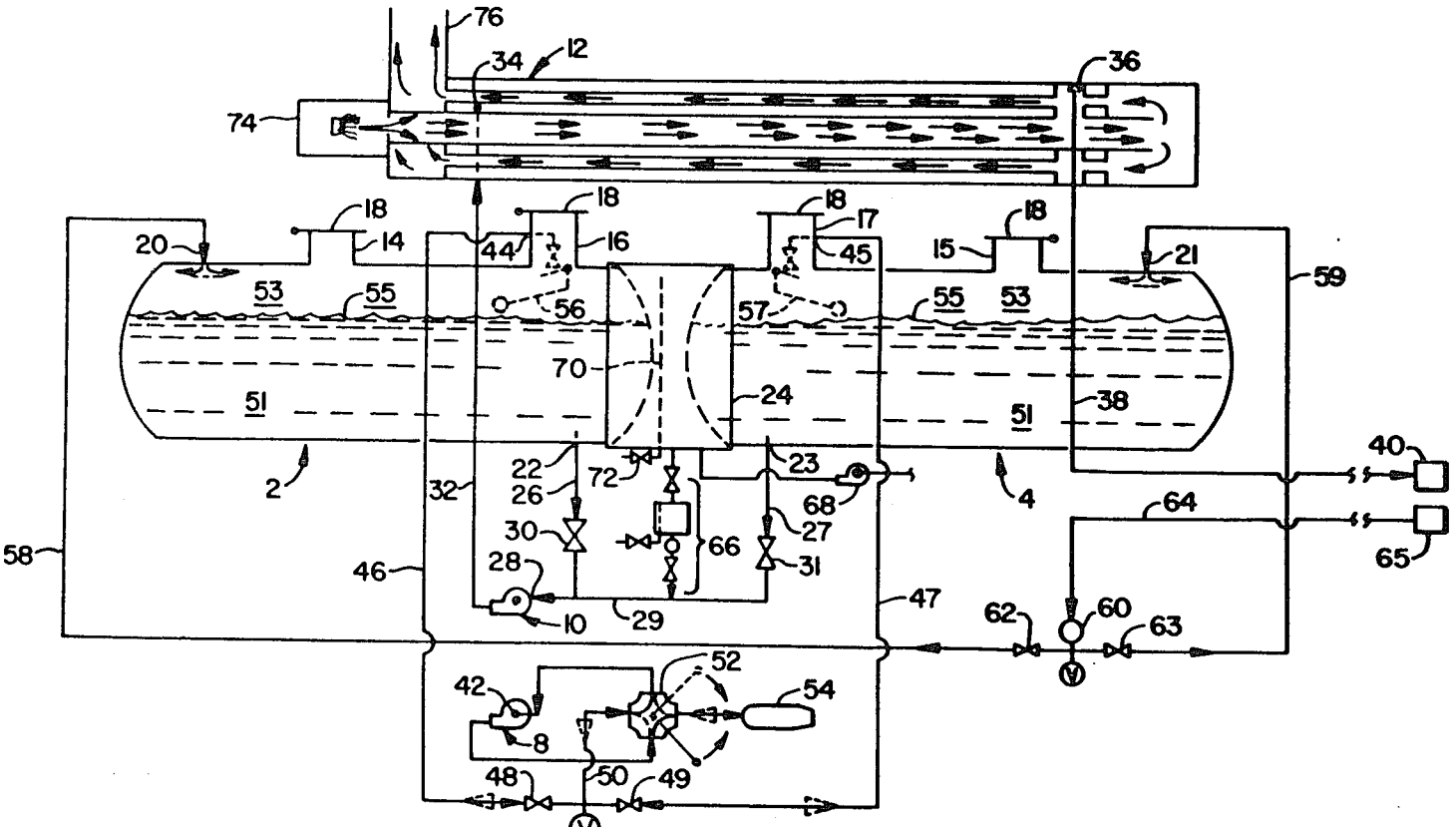
FIG. 2 is a schematic flow diagram of the apparatus of FIG. 1.

Turning now to FIGS. 1 and 2, the tank cleaning system of the present invention broadly includes a pair of pressure vessels 2, 4, mounted to a trailer 6. A vacuum pump 8, a pressure pump 10, and a heat exchanger 12 are also mounted to the trailer and are interconnected to the pressure vessels via various pipes and valves as described in more detail below.

The two pressure vessels, typically holding 3,500 gallons each, each have a fill hatch 14, 15 and a vacuum hatch 16, 17. These hatches extend from the top of the cylindrical wall of the vessels. Each has a removable cover plate 18 for access into the interior of the vessels. The vessels also have suction inlets 20, 21 communicating with the interiors of the vessels at the end of the tank opposite respective vacuum hatches 16, 17. Liquid outlets 22, 23 are located along the lowermost portion of the vessels.

Pipes 26, 27 fluidly connect outlets 22, 23 to the inlet 28 of pressure pump 10 through coupling pipe 29 and valves 30, 31 respectively. The outlet of pump 10 communicates through a pipe 32 with the inlet 34 of heat exchanger 12. Pump 10 thus can pump liquid from either pressure vessels 2 or 4 through the selective operation of valves 30, 31 into the heat exchanger. Liquid flows through the heat exchanger and exits through an outlet 36. A suitable high pressure line 38, shown only in FIG. 2, can be connected to outlet 36 to direct the pressurized and heated liquid to the appropriate area. The outer end of line 38 can have a variety of spray nozzles 40 connected thereto depending upon the particular configuration of the surface being cleaned.

The vessels are cylindrical with convex ends and are mounted end to end on trailer 6. The space between the opposed convex ends of the two vessels forms a cleaning agent container 24, typically holding 500 gallons, for the storage of concentrated cleaning agents.

The cleaning agent within container 24 can be added to the liquid dumped from either vessel 2 or vessel 4 through metering apparatus 66. Container 24 is filled with an appropriate cleaning agent by a pump 68. A standpipe 70 within container 24 is connected to a valve 72 to allow the escape of trapped gas when filling the container.

The inlet 42 of vacuum pump 8 is normally connected to vacuum outlets 44, 45 through respective pipes 46, 47. Vacuum outlets 44, 45 are located on the side walls of vacuum hatches 16, 17, respectively. Valves 48, 49 are positioned along pipes 46, 47 to control which pressure vessel will be in fluid communication with vacuum pump 12. A common line 50 connects pipes 46, 47 to inlet 42 through a four-way valve 52. The outlet of vacuum pump 12 is connected to a muffler 54 through four-way valve 52. The four-way valve alternatively allows the vacuum pump to be used to pressurize vessels 2, 4 as more fully described below.

In normal operation, the vacuum pump draws a vacuum in a space 53 above the free surface 55 of the liquid 51 within one of the pressure vessels. Suction inlets 20, 21 are located in vessels 2, 4 above free surface 55. Shut-off valves 56, 57 prevent liquid within the vessels from passing through vacuum outlets 44, 45 to prevent damage to pump 12. Pipes 58, 59 are connected to suction inlets 20, 21 and are joined at a common vacuum return fitting 60. A pair of valves 62, 63 are used to control passage along pipes 58, 59. One end of a common vacuum line 64, shown only in FIG. 2, is connected to fitting 60. The outer end 65 of vacuum line 64 is used to siphon off cleaning fluid and dislodged contaminants from the surface being cleaned. Tanks often have a drain outlet so that the outer end of the vacuum line can be attached to the outlet with a suitable fitting. Other tanks may not have such an outlet, so that a suitable suction head may be used and placed on, and preferably anchored to, the bottom of the tank.

Heat exchanger 12 is mounted to trailer 6 adjacent to and parallel to vessel 4. A burner 74 is mounted at one end and is used to heat the liquid flowing through the heat exchanger. Gases are exhausted through a flue 76.

The operation of the tank cleaning system proceeds essentially as follows. For the sake of the following discussion, vessel 2 will be used as the supply of cleaning liquid. Valve 30 is opened and valve 31 is closed so that upon activation of pressure pump 10, liquid within vessel 2 is pumped from vessel 2 to the heat exchanger, through high pressure line 38, and into the tank to be cleaned. The pump develops relatively high pressures, for example, 200 psi, to enhance the cleaning efficiency of the system. If the cleaning liquid is to be a water-based product, a cleaning agent, such as trisodium phosphate, is usually metered through metering apparatus 66 into the liquid being pumped from vessel 2, typically water. If the cleaning liquid is a solvent such as diesel fuel or jet fuel, a concentrated cleaning agent may not necessarily be added to the liquid.

Simultaneously while spraying the cleaning liquid into the tank, the vacuum pump operates to draw a vacuum on vessel 2 through vacuum outlet 44. This causes a suction force on vacuum line 64, valve 63 being closed and valve 62 being open. The outer end of the vacuum line, being placed at a low point in the tank, therefore sucks up the cleaning liquid and dislodged contaminants from the bottom of the tank. These contaminants may be liquids or solids. The cleaning liquid and contaminants sucked up by the vacuum line pass through pipe 58 and enter vessel 2 through suction inlet 20.

Since vacuum pump 12 operates only to draw gas from the space 53, it operates relatively independently of what is being sucked up by vacuum line 64. Therefore, a high suction level can be maintained, one which is insensitive to sucking air and to the type of contaminants, both solids and liquids, being drawn into the vacuum line. By maintaining a high degree of suction, the tank being cleaned can be kept relatively free from pools of cleaning liquid so that the effectiveness of the sprayed cleaning liquid is insured. Gaseous emissions from the tank being cleaned can be eliminated by insuring that a sufficient quantity of gas is sucked in with the liquids and contaminants.

It should be noted that the normal flow directions along the pipes and lines are shown by solid arrows. However, by placing four-way valve 52 in an alternative configuration shown by dashed lines in FIG. 2, the vacuum pump can be used to pressurize either of the pressure vessels through outlets 44, 45. This feature is useful when cleaning the pressure vessels. For example, if it is desired to clean pressure vessel 2, four-way valve 52 is shifted to pressurize vessel 4. Valve 49 will be open while valve 48 will be closed. This allows the user to energetically force the liquid out of pressure vessel 4 and through vessel 2, thus cleaning vessel 2.

Figure 3:
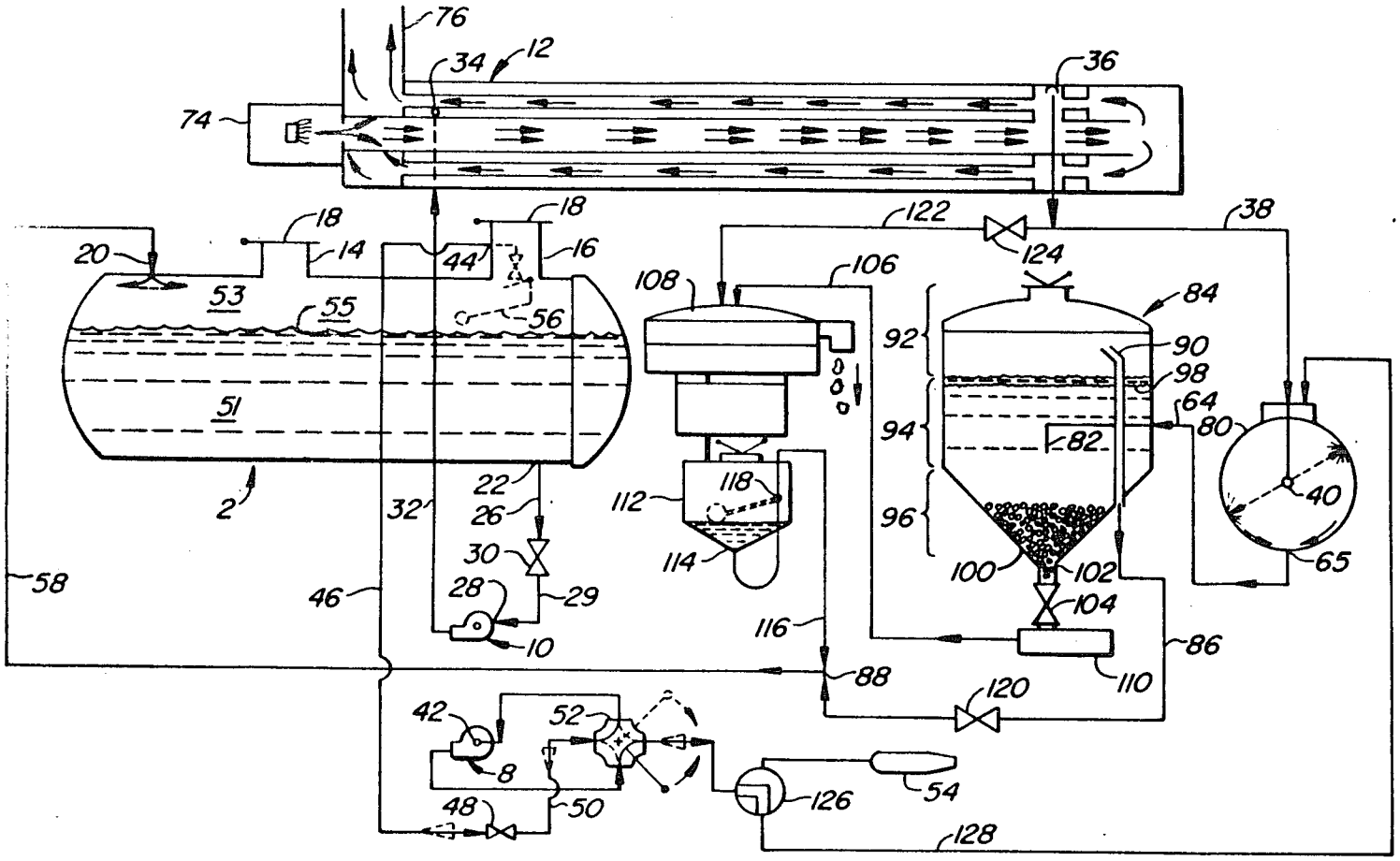
FIG. 3 is a schematic flow diagram of apparatus made according to the present invention including a heavy sediment separator tank.

Turning now to FIG. 3, an alternative embodiment of the invention is shown. As is evident from the figure, the embodiment of FIG. 3 includes the components of FIG. 2 with the exception of pressure vessel 4, cleaning agent container 24 and associated piping and valves. Common vacuum line 64 is connected at its outer end 65 to the bottom of a dirty tank 80. The inner end 82 of line 64 terminates within a heavy sediment separator tank 84. Pipe 58 is fluidly connected to an air suction pipe 86 via a T-joint 88. An end 90 of pipe 86 communicates with an upper region 92 of tank 84. Thus, the partial vacuum within space 53 creates a partial vacuum within tank 84 to withdraw liquids, solids and gases from within tank 80 through line 64 for deposit within tank 84 through inner end 82.

FIG. 3 indicates that tank 84 includes three vertically ordered regions therein. Upper region 92 contains gases at a partial vacuum, a middle region 94 contains liquid and a lower region 96 contains a mixture of solids (sucked up from dirty tank 80) and liquid. A rag screen 98 is placed within middle region 94 to keep rags and other floating debris sucked out of dirty tank 80 from collecting on the surface of the liquid within tank 84.

The lower portion 100 of tank 84 is conical and terminates at a solids/liquid outlet 102. The mixture of solids and liquid collected at the base of lower portion 100 pass through a valve 104 and is pumped through a solids/liquid discharge pipe 106 to a solids separator 108 by a progressive cavity pump, such as that made by the Moyno Pump Division of Robbins & Meyers Co. of Springfield, Ohio. Solid separator 108 may be of a commercially available type, such as that made by Sweco, Inc. of Los Angeles, Calif. Under the proper conditions it may be possible to locate solid separator 108 vertically below valve 104 so that pump 110 is not necessary.

Separator 108 removes relatively large solids, such as rocks and rags, from the solids/liquid mixture drawn from tank 84. Separator 108 includes a liquid pot 112 having a liquid outlet 114 coupled by a liquid suction pipe 116 to T-joint 88. A liquid level sensitive shut-off valve 118 is mounted along pipe 116 to close the pipe when the liquid level in pot 112 drops below a predetermined level. A shut-off valve 120 is provided along air suction pipe 106 for selectively sealing pipe 106. A supplementary high-pressure line 122 connects high-pressure line 38 with solids separator 108 to supply the separator with a source of heated, pressurized liquid. A shut-off valve 124 is provided along line 122 to shut-off the supply of cleaning liquid to separator 108 when it is not needed.

Another distinction between the apparatus of FIG. 2 and FIG. 3 is the selective coupling of the exhaust from vacuum pump 8 to either muffler 54 or dirty tank 80. This is accomplished by the actuation of a valve 126 which directs the exhaust either through muffler 54 or to dirty tank 80 along a line 128. By connecting exhaust of pump 8 to dirty tank 80, it being substantially sealed, the cleaning system becomes a closed loop in which no gases or vapors are allowed to escape into the atmosphere.

In use, the apparatus disclosed in FIG. 3 operates similar to the apparatus of FIGS. 1 and 2 described above. At initial start-up, liquid pot 112 would be substantially empty so that valve 118 is closed. Valves 104 and 124 would typically be closed while valve 120 would be opened. The partial vacuum within space 53 pulls a partial vacuum within tank 84 causing liquid, solids and gases to be pulled into tank 84 through line 64. As cleaning progresses, liquid and solids begin to collect within lower region 96. To remove the solids, valves 104 and 124 are opened and pump 110 is actuated to pump a mixture of solids and liquid from outlet 102, through pipe 106 and into solids separator 108. When sufficient liquid has collected within liquid pot 112, shut-off valve 118 opens. This allows the partial vacuum within space 53 to suck the liquid from liquid pot 112 through pipes 116 and 58 as well as the gases and vapors from upper region 92 through pipes 86 and 58. With valves 52 and 126 in their respective positions of FIG. 3, vacuum pump 8 exhausts through valves 52 and 126 into dirty tank 80, which is substantially sealed to prevent gases and vapors from escaping into the atmosphere. If desired, scrubbers and other such apparatus may be used, such as along pipe 46, to remove certain gases or vapors passing through such pipe.

Figure 4:
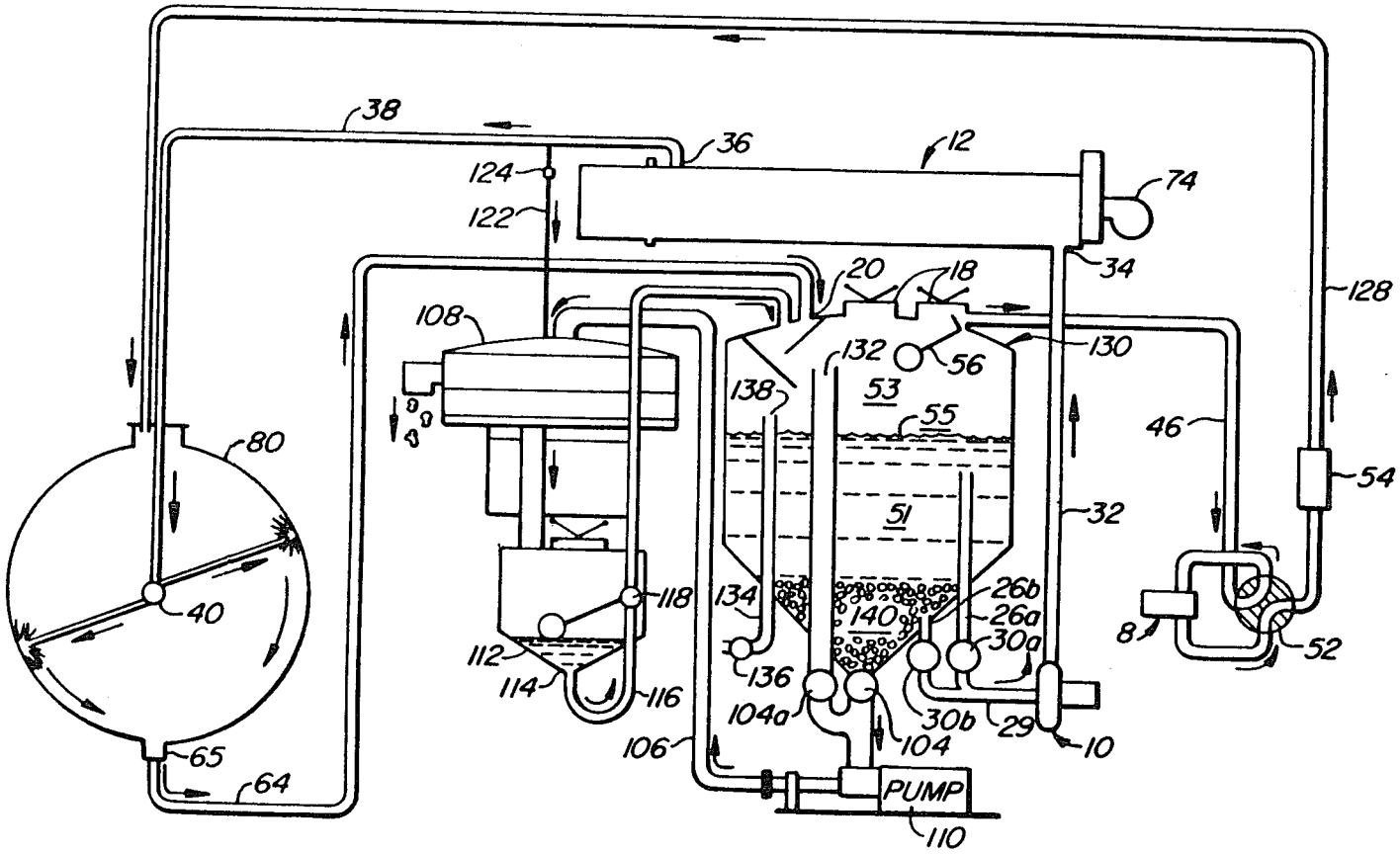
FIG. 4 is an alternative embodiment of the apparatus of FIG. 3 in which the pressure vessel and heavy sediment separator tank are incorporated into a single main vacuum tank.

Turning now to FIG. 4, another embodiment of the invention suitable for use when substantial amounts of relatively large solids are to be removed from the dirty tank is disclosed. A main vacuum tank 130 functionally replaces pressure vessel 2 and separator tank 84 of FIG. 3. The main structural distinctions are as follows. Two liquid inlet pipes 26*a*, 26*b*, each controlled by its associated valve 30*a*, 30*b*, are provided so that liquid 51 may be withdrawn from different locations within main vacuum tank 130. Liquids, solids and gasses are sucked into tank 130 through vacuum line 64 while liquid is sucked from liquid pot 112 through line 116. The rag screen mounted within tank 84 of FIG. 3 is not used because of the overhead deposit of solids, liquids and gasses through suction inlet 20. To remove an accumulation of rags and other floating debris, a floating solids removal line 132 is connected to pump 110 through a valve 104*a*. When floating solids/debris reaches the level of the upper end of line 132, valve 104*a* is opened allowing pump 110 to pump the floating debris from tank 130 for separation by solids separator 108. A decanting line 134, controlled by a shut-off valve 136 is used to remove any liquid 51 above its open upper end 138 to maintain free surface 55 below the height of upper end 138. This may be necessary when the dirty tank has a relatively large quantity of liquid in it before being cleaned. Essentially, the apparatus of FIG. 4 takes pressure vessel 2 of FIG. 2 and replaces it with main vacuum tank 130 while adding pump 110 and solids separator 108 and their associated lines and valves.

In use, if there is no appreciable sediment within the lower region 140 of tank 130, then valves 104, 104*a*, 124 and 118 will be closed. Vacuum pump 8 will pull a partial vacuum within space 53 causing solids, liquids and gasses within dirty tank 80 to be pulled through outer end 65 of vacuum line 64 and into tank 130 through suction inlet 20. Meanwhile, pressure pump 10 pumps cleaning liquid 51 from tank 130, through line 32, heat exchanger 12, pressure line 38 and out spray nozzle 40 so that the cleaning liquid impacts on the inner surface of tank 80. To insure that undesirable gasses and vapors are not released into the atmosphere, the exhaust from vacuum pump 8 is pumped through four-way valve 52, muffler 54, line 128 and into tank 80.

To remove solids settling in the lower region 140 of tank 130, valves 104 and 124 are opened and pump 110 is actuated pumping a solids/liquid mixture through pipe 106 and into separator 108. When sufficient liquid has been collected in liquid pot 112 so that shut-off valve 118 is opened, the partial vacuum within space 53 pulls the liquid from pot 112 through liquid suction pipe 116 and into tank 130. To remove floating solids, valve 104*a* is opened allowing the solids to be pulled by pump 110 from tank 130 into solids separator 108.

The present invention is particularly suited for cleaning containers such as tanks. However, it can also be used for cleaning areas where a liquid is sprayed onto a surface and can be collected at a low point. For example, certain rooms or buildings may be amenable for cleaning by the apparatus of the present invention. Other modification and variation may be made to the disclosed preferred embodiment without departing from the subject of the invention as defined in the following claims.

I claim:

1. A cleaning system comprising:

a first vessel, having a first liquid outlet adapted to hold a cleaning liquid, said liquid having a free surface in said vessel, said first vessel having a space above the free surface containing gaseous components;

means for pumping said liquid from the first liquid outlet through a first line;

means, communicating with the space, for substantially continuously creating a partial vacuum in said space by substantially continuously withdrawing said gaseous components;

a second vessel having a solids/liquid outlet;

solids separator means having a second liquid outlet and an inlet, the inlet fluidly coupled to said solids/liquids outlet of said second vessel, said solids separator means adapted to separate solids from liquid and to direct the separated liquid to the second liquid outlet;

means for fluidly coupling said second liquid outlet and said second vessel to said first vessel; and a return line having an inner end fluidly connected to said second vessel and an outer end at which a vacuum is created by the fluid coupling means.

2. The cleaning system of claim 1 further comprising means for directing said cleaning liquid from said first line onto a surface to be cleaned.

3. The cleaning system of claim 2 including means for heating said cleaning fluid prior to passing from said directing means.

4. The cleaning system of claim 2 wherein said fluid coupling means includes:

a second line connecting said second liquid outlet at one end and said second vessel at the other end, said other end located above said solids/liquid outlet;

said first vessel having a suction inlet; and a third line fluidly coupling the suction inlet of said first vessel to an intermediate point along said second line.

5. The cleaning system of claim 4 wherein said suction inlet communicates directly with said space.

6. The cleaning system of claim 2 wherein said inner end of said return line is positioned at a central position within said second vessel.

7. The cleaning system of claim 6 further comprising a porous rag screen mounted within said second vessel above said inner end of said return line.

8. The cleaning system of claim 2 further comprising a solids/liquid pump means for pumping solids and liquid from said solids/liquid outlet to said inlet of said solids separator means.

9. A cleaning system for use in combination with a cleaning liquid and a tank to be cleaned comprising:

a first vessel, having a first liquid outlet, adapted to hold the cleaning liquid, said liquid having a free surface in said vessel defining a space above the free surface containing gasses;

a first line;

means for pumping said liquid from the first liquid outlet in said first vessel through the first line;

means for heating said liquid passing through said first line;

means for directing said cleaning liquid from said first line onto the interior surface of the tank to be cleaned;

means communicating with the space in said first vessel above said free surface of said cleaning liquid for substantially continuously withdrawing the gasses from the space for creating a partial vacuum in said space;

a second vessel including a solids/liquids outlet;

solids separator means, including a separator liquid outlet, having a separator inlet fluidly coupled to said second vessel at the solids/liquids outlet of said second vessel, said solids separator means adapted to separate solids from liquid and to direct the separated liquid to the separator liquid outlet;

means for fluidly coupling said separator liquid outlet and said second vessel to said first vessel; and a return line having an inner end fluidly connected to said second vessel and an outer end fluidly connected to the interior of the tank at a bottom region thereof, whereby a partial vacuum is created at the outer end through said fluid coupling means, said second vessel and said return line.

* * * * *